US007959689B2

(12) United States Patent
Cagle

(10) Patent No.: US 7,959,689 B2
(45) Date of Patent: Jun. 14, 2011

(54) CANDLE MADE FROM MULTIPLE WAX MATERIALS WITH DIFFERENT MELTING POINTS

(75) Inventor: John Cagle, Greenfield, MA (US)

(73) Assignee: The Yankee Candle Company, Inc., South Deerfield, MA (US)

( * ) Notice: Subject to any disclaimer, the term of this patent is extended or adjusted under 35 U.S.C. 154(b) by 726 days.

(21) Appl. No.: 11/391,760

(22) Filed: Mar. 29, 2006

(65) Prior Publication Data

US 2007/0169405 A1 Jul. 26, 2007

Related U.S. Application Data

(63) Continuation-in-part of application No. 11/338,264, filed on Jan. 24, 2006, now abandoned.

(51) Int. Cl.
*C11C 5/00* (2006.01)

(52) U.S. Cl. ..... 44/275; 431/288; 431/289

(58) Field of Classification Search ..... 44/275; 431/288, 289

See application file for complete search history.

(56) References Cited

U.S. PATENT DOCUMENTS

| | | | | |
|---|---|---|---|---|
| 4,028,045 | A * | 6/1977 | Reiher | 431/289 |
| 4,427,366 | A * | 1/1984 | Moore | 431/291 |
| 4,568,270 | A * | 2/1986 | Marcus et al. | 431/288 |
| 6,096,102 | A | 8/2000 | Matthai et al. | |
| 2002/0139041 | A1 | 10/2002 | Calzada | |
| 2004/0248762 | A1 | 12/2004 | McGee et al. | |

FOREIGN PATENT DOCUMENTS

WO WO-01/55639 8/2001

OTHER PUBLICATIONS

International Search Report and Written Opinion, International Application No. PCT/US2007/001864, The Yankee Candle Company, Inc., Sep. 16, 2008, 9 pages.

* cited by examiner

*Primary Examiner* — Cephia D Toomer
(74) *Attorney, Agent, or Firm* — Wilmer Cutler Pickering Hale & Dorr LLP.

(57) ABSTRACT

A scented candle includes at least two different wax materials with one of the materials having one melting point and at least one of the other wax materials having a second higher melting point. The wax having the higher melting point may include a malodor control agent or odor abatement substance or alternatively a fragrance that is different than the fragrance in the other wax materials in the candle. The second fragrance may also be at a much higher concentration than the fragrances in the other wax materials contained in the candle.

7 Claims, 1 Drawing Sheet

CANDLE MADE FROM MULTIPLE WAX MATERIALS WITH DIFFERENT MELTING POINTS

CROSS REFERENCE TO RELATED APPLICATION

This application is a continuation-in-part of U.S. patent application Ser. No. 11/338,264 filed Jan. 24, 2006.

BACKGROUND OF THE INVENTION

The present invention relates to scented candles and more particularly to a scented candle having at least two types of wax with different melting points.

With the increasing popularity of scented candles, consumer demand has risen for candles having a combination of a variety of fragrances. In some cases, wax has been layered or swirled in a candle so that two different types of wax are visible, generally through the glass enclosure for the candle but also by viewing the top of the candle. As the candle burns, the scents of both waxes are released to provide this blended scent. For example, The Yankee Candle Company sells a candle under the name Cranberry Peppermint and that candle will provide the scent of both cranberry and peppermint as it burns.

In many known candles having multiple waxes with different fragrances, the waxes containing the various scents each have the same melting point so that both scents are released as the wax melts. In some cases, the waxes are arranged in the candle so that there is more wax containing the predominant scent or so that one scent is released at a different time then another scent in the candle. In addition, other technologies have been developed in recent years that actually remove odors from the air and to make the scent of the candle more effective. Such technology is often referred to as an odor abatement system or malodor control agents.

In U.S. Pat. No. 4,028,045 issued to Reiher, a candle is described that is made from two different wax compositions with the wax making up the main body of the candle having a higher melting point than the wax included in a wax insert. This candle was designed to address the problem caused by the fragrance material included in the scented candles reducing the melting point of the wax and also softening the wax. By placing the wax with the higher burning point and harder composition around a scented wax composition with the lower melting point, the candle was better able to maintain its integrity. The candle described in this patent, however, does not have any fragrance in the outer wax material because Reiher sought to avoid the softening of such wax material that results from such a combination.

It is a principal object of the present invention to provide a candle in which the release of fragrance can be controlled through the use of wax having more than one melting point.

Another object of the present invention is to provide a scented candle that also makes use of an odor abatement system.

SUMMARY OF THE INVENTION

The present invention is a scented candle that includes at least two different wax materials with one such wax material having one melting point and at least one of the other wax materials having a second melting point. In some embodiments, the wax composition having the higher melting point surrounds the wick. One or both of the wax materials may include malodor control agents. The wax having the higher melting point may include a fragrance that is different from the fragrance in the other wax materials in the candle. In other embodiments the second fragrance is at a much higher concentration than the fragrances in the other wax materials contained in the candle.

DETAILED DESCRIPTION OF PREFERRED EMBODIMENTS

Figure 2:
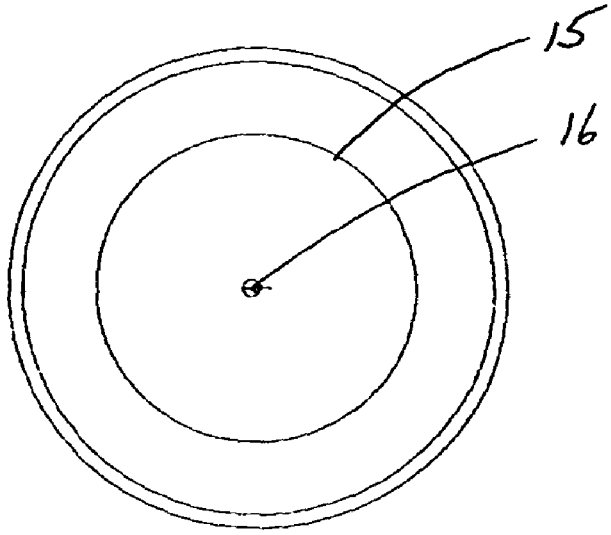
FIG. 2 is a top view of the candle shown in FIG. 1.
Figure 1:
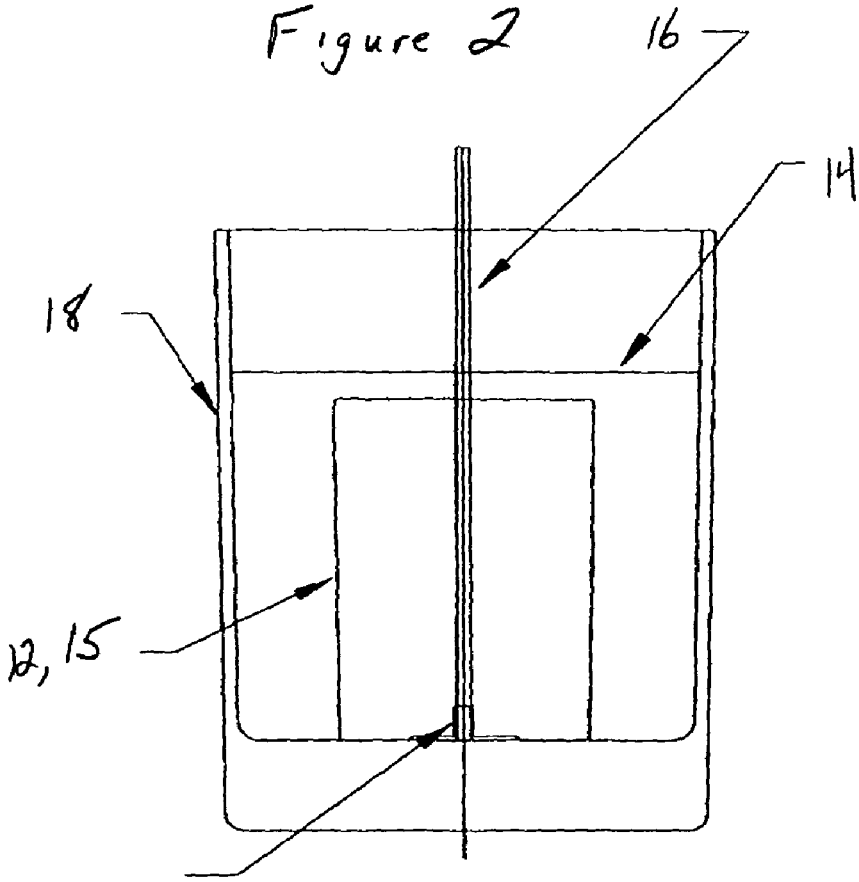
FIG. 1 is a cross-sectional view of a candle of the present invention having two wax materials.

With reference to FIGS. 1 and 2, a candle 10 is shown having two different wax compositions. A first wax material 12 has a first melting point of between 115° F. and 135° F., which in a preferred embodiment is between 120° F. and 130° F. A second wax material 14 has a higher melting point of between 130° F. and 150° F., and is preferably between 135° F. and 145° F. Even though the possible ranges overlap the melting point of wax material 12 will always be lower than the melting points of wax material 14. In other embodiments the candle may contain more than two wax compositions with multiple melting points to achieve the desired effects. In the embodiment shown in FIGS. 1 and 2, the wax material 14 is positioned as a centered core 15 in which a wick 16 is centrally threaded. The core 15 of wax material 14 extends through the body of the candle 10.

In one embodiment of the present invention the wax material 14 includes an odor abatement substance. A suitable odor abatement material is sold by Givaudan Inc. of Teaneck, N.J. under the trademark NEUTRAQ. This odor abatement material would preferably be incorporated into the wax material 14 in order to remove odors from the air other than the scent being emitted by the candle. The NEUTRAQ odor abatement material is also described in United States Published Application No. US2004/0248762 that was published on Dec. 9, 2004. This odor abatement material binds with Amines, thiols, sulfides, and other malodor molecules that are not found in fragrance raw materials. Thus, NEUTRAQ can exist in the candle body 12 or the higher temperature wax insert 14 or both.

In another embodiment of the present invention the wax material 12 has a first concentration of fragrance and the wax material 14 has a higher level of a second fragrance.

In certain embodiments, the color of the wax material 14 is different than the color of the other wax material 12 in the candle. As the candle 10 burns, a change in color in such a candle will be noticed soon after ignition of the wick 16. The color change occurs in the center of the candle where the wick is located which has the effect of letting the user know that the malodor control agent or the fragrance is being released.

In the preferred embodiment, the core 15 is manufactured by mixing together high melt point fully refined paraffin, broad cut microcrystalline wax, hyperbranched polymer, a fragrance or odor abatement material, ultra violet light stabilizers, antioxidants and pigments as is well-known in the art. These materials are mixed and melted into a homogenous liquid state creating a molten "blend". A molten blend is then sprayed into the air via nozzles with an orifice of 0.35 mm or 0.4 mm onto a rotating cold drum where it forms small spheres (approximately 0.25 mm-1.25 mm in diameter). The small spheres are scraped off the cold drum into a vibrating pan and collected at a point of vacuum. The vacuum delivers small spheres into a candle pressing molding machine, such as the machine sold by Herrhammer, GmbH under Model No. STFM-1/450/3. The small spheres are compressed under pressure around a wick 16 to form an extruded solid wax blend which may then be trimmed to the desired height and width. The core 15 may represent 10%-80% of the volume of the candle with 20%-60% being the preferred range.

To manufacture the candle 10 of the present invention, the wax material 12 is poured into ajar 18. While the wax material 12 is still liquid, the core 15 of wax material 14 of the higher melting point is then inserted in a central position in the candle 10. The difference in melting points between the candle body wax material 12 and the core wax material 14 allows for a placement of the core 15 in a liquefied wax body 12 without jeopardizing the integrity of the wax material 14. The candle body is cooled to complete solidification and subsequently topped off with additional wax in an effort to create a level end-use product. It is also possible that the level of the wax body may be just below or even with the core 15. The wick 16 is cut to an appropriate length. The difference in melting points between the core 15 of wax material 14 and the body of wax material 12 allows for higher pouring temperatures of the body (required to ensure homogeneity of the body's formulation) without jeopardizing the integrity of the core 15.

While the foregoing invention has been described with reference to its preferred embodiments, various alterations and modifications will occur to those skilled in the art. All such alterations and modifications are intended to fall within the scope of the appended claims.

What is claimed is:

1. A candle comprising:

a wick;

a first wax material having a first melting point, said first wax material being in direct contact with said wick and surrounding said wick along substantially the entire length of said wick;

a second wax material having a second melting point, said second melting point being higher than said first melting point, said second wax material being arranged to surround said first wax materials;

an odor abatement material included in at least one of said first wax material and said second wax material, said odor abatement material possesses the capability to remove malodors from the air around the candle;

a fragrance included in at least one of said first wax material and said second wax material.

2. The candle of claim 1 wherein said first wax material and said second wax material each further comprise a fragrance.

3. The candle of claim 2 wherein said fragrance in said second wax material is at a higher concentration than the concentration of said fragrance in said first wax material.

4. The candle of claim 1 wherein said first wax material comprises a color pigment of a first color and said second wax material comprises a color pigment of a second color wherein said first and second colors are different.

5. The candle of claim 2 wherein said odor abatement material possesses the capability to remove malodors from the air other than said fragrance emitted by said first wax material and said second wax material.

6. The candle of claim 5 wherein said odor abatement material binds molecules not found in said fragrances.

7. The candle of claim 1 wherein said odor abatement material is included in only one of said first wax material and said second wax material and said fragrance is included only in the other of said first wax material and said second wax material that does not include said odor abatement material.

* * * * *